US006981601B2

(12) United States Patent
Laveault et al.

(10) Patent No.: US 6,981,601 B2
(45) Date of Patent: Jan. 3, 2006

(54) TAMPER-EVIDENT SNAP-ON CLOSURE WITH SEALING PLUG AND LINER

(75) Inventors: Richard Laveault, Crawfordsville, IN (US); Coy Hearld, Crawfordsville, IN (US); Stephen McBride, Crawfordsville, IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 120 days.

(21) Appl. No.: 10/103,683

(22) Filed: Mar. 21, 2002

(65) Prior Publication Data

US 2003/0178385 A1 Sep. 25, 2003

(51) Int. Cl.
*B65D 41/32* (2006.01)

(52) U.S. Cl. ..... 215/253; 215/354; 215/341; 215/305; 215/DIG. 1

(58) Field of Classification Search ..... 215/250, 215/253, 295, 301, 305, 317, 320, 350, 341, 215/354, DIG. 1
See application file for complete search history.

(56) References Cited

U.S. PATENT DOCUMENTS

| | | | | |
|---|---|---|---|---|
| 3,292,807 A | * | 12/1966 | Golde | 215/305 |
| 3,331,523 A | * | 7/1967 | Exton | 215/350 |
| 3,653,529 A | * | 4/1972 | Segmuller | 215/256 |
| 3,661,289 A | * | 5/1972 | Segmuller | 215/256 |
| 3,899,097 A | | 8/1975 | Aichinger | |
| 3,985,255 A | | 10/1976 | Blair | |
| 4,003,488 A | | 1/1977 | Moller | |
| 4,128,184 A | * | 12/1978 | Northup | 215/222 |
| 4,346,812 A | * | 8/1982 | Banich, Sr. | 215/352 |
| 4,351,443 A | * | 9/1982 | Uhlig | 215/216 |
| 4,423,822 A | | 1/1984 | Powalowski | |
| RE31,869 E | | 4/1985 | Harding | |
| 4,522,308 A | | 6/1985 | Sullivan | |
| 4,640,428 A | | 2/1987 | Chang | |
| 4,919,286 A | | 4/1990 | Agbay, Sr. | |
| 5,292,017 A | | 3/1994 | Reifers | |
| 5,341,949 A | | 8/1994 | Hayes | |
| 5,762,217 A | * | 6/1998 | Ohmi et al. | 215/253 |
| 5,842,592 A | | 12/1998 | Beck | |
| 5,984,125 A | | 11/1999 | Price et al. | |
| 6,299,005 B1 | | 10/2001 | Higgins | |

FOREIGN PATENT DOCUMENTS

| | | | |
|---|---|---|---|
| GB | 2297711 | * | 8/1996 |
| WO | PCT/WO01/68467 | | 9/2001 |

* cited by examiner

*Primary Examiner*—Robin A. Hylton
(74) *Attorney, Agent, or Firm*—Tracey D. Beiriger; Eckert Seamans Cherin & Mellott, LLC

(57) ABSTRACT

A snap-on plastic closure for a container includes a top wall portion, an annular skirt portion depending from the top wall portion, and a removal tab projecting forwardly from the skirt portion for manipulation of the closure during removal. A sealing plug depends from the inside surface of the top wall portion for disposition generally within the mouth of an associated container. The skirt portion of the closure includes a deformable region positioned beneath the removal tab so that during closure removal, the deformable region is permanently stretched and deformed for tamper-indication.

22 Claims, 5 Drawing Sheets

TAMPER-EVIDENT SNAP-ON CLOSURE WITH SEALING PLUG AND LINER

TECHNICAL FIELD

The present invention relates generally to closures for bottles and like containers, and more particularly to a plastic, snap-on closure for a container which is configured for convenient removal without openers or the like, and which provides visually discernable tamper-evidence.

BACKGROUND OF THE INVENTION

Various constructions for container closures have been developed over the years in order to provide effective closure and sealing, while permitting convenient closure removal for consumption or use of the container contents. By way of example, use of internally threaded, molded plastic closures has become increasingly widespread by virtue of the sealing integrity which they provide, especially for carbonated beverages, while facilitating convenient removal by consumers. U.S. Pat. Nos. 4,407,422, 4,497,765, 4,418,828, and 4,938,370, all hereby incorporated by reference, disclose various compression-molded plastic closures which have proven to be very commercially successful, in part due to the tamper-indicating features with which such closures can be provided.

Internally-threaded closures of the above type have, in part, supplanted use of metal, so-called crowns, which have been, and continue to be employed on beverage containers. While closures of this type provide the desired sealing integrity, such closures have typically required use of an opener or like implement to effect their removal from an associated container. While manually-removable "twist-off" crowns are known, such closures require a specialized container "fmish" at the neck portion, and can still be difficult for some consumers to remove without use of an opener or the like. Additionally, metal crown closures typically do not include any specific tamper-indicating feature, which can be desirable to assure consumers of a container's integrity.

In view of the foregoing, it is desirable to provide a closure for a container which can be efficiently applied, and easily removed by consumers without an associated opener or like implement. Aside from providing the desired sealing integrity, particularly for carbonated contents, it is desirable to provide a closure which is configured for tamper-evidence.

SUMMARY OF THE INVENTION

The plastic closure embodying the principles of the present invention is configured for snap-on application to an associated container, and removal by consumers without use of an opener or like implement. Notably, the present snap-on closure is configured to provide tamper-evidence in a manner which is clearly visually discernable by consumers. The present closure is desirably straightforward in configuration, thus facilitating efficient, cost-effective manufacture, and is readily adaptable to existing container finishes, such as commonly employed with metal closure crowns.

A snap-on closure embodying the principles of the present invention includes a top wall portion, and an annular skirt portion depending from the top wall portion. In the preferred configuration, the closure includes a removal tab which projects forwardly from the skirt portion, and facilitates convenient removal by consumers without a closure opening implement.

Sealing of the associated container is effected by the provision of a generally cylindrical sealing plug which depends from an inside surface of the top wall portion of the closure. The sealing plug is configured for disposition generally within the mouth of an associated container. Depending on the specific application, the present closure can be provided in a composite form, and include a sealing liner disposed on the sealing plug for sealing engagement with the associated container. The sealing liner may be formed separately, or molded on the sealing plug. Retention of the sealing liner on the sealing plug is enhanced by the provision of an annular retention lip defined by one of the sealing plugs in the sealing liner, with the other of the plug and liner defining an annular retention groove for receiving the retention lip. In the illustrated embodiment, the sealing plug defines an annular retention groove on its outwardly facing surface, with the sealing liner defining an annular sealing lip disposed within an annular channel of the liner, with a free edge of the sealing plug positioned within the annular channel.

In one illustrated embodiment, the sealing liner has an axial dimension less than the axial dimension of the sealing plug, with the liner including a central portion positioned generally within the sealing plug. At least one support rib depends from the top wall portion of the closure generally within the sealing plug for supporting the central portion of the liner. In the illustrated embodiment, a pair of support ribs, arranged in generally parallel relationship, are provided. In a current embodiment, the removal tab of the closure projects outwardly from the skirt portion perpendicularly to the one or more support ribs. In an alternate embodiment, an in-situ molded sealing liner is coextensive with the sealing plug, and includes a central portion positioned generally within the sealing plug adjacent the top wall portion of the closure.

In order to provide tamper-evidence attendant to removal of the present closure from an associated container, the annular skirt portion of the closure includes a deformable region positioned generally beneath the removal tab. The annular skirt defines a circumferential gap extending above the deformable region, such that the deformable skirt portion is generally separated and distinguished from the portion of the closure immediately thereabove. Undesired deformation of the deformable region of the skirt portion during closure application is avoided by the provision of a bridge element, positioned at the circumferential gap, for bearing axial loads during application of the closure to a container.

The closure is retained on the associated container by the provision of at least one inwardly projecting retention bead. In the preferred form, a plurality of inwardly projecting, circumferentially spaced retention beads are provided, with the tamper-indicating deformable region of the skirt portion having one of the retention beads thereon. In accordance with the illustrated embodiment, an elongated one of the retention beads is provided on the skirt portion opposite the removal tab. The elongated retention bead preferably defines an opening positioned diametrically opposite the removal tab to facilitate manufacture of the present closure.

During closure removal, the removal tab of the closure is urged upwardly, with the closure defining a flexure region which extends across the top wall portion thereof, generally between the center of the top wall portion and the removal tab. During removal, the deformable region of the skirt portion initially retained on the container by its retention bead, becomes separated from the top wall portion and removal tab as the closure flexes. As opening movement is continued, the deformable region of the skirt portion is permanently stretched and deformed before the retention bead on the deformable region moves off of the container finish as the closure is completely removed.

Other features and advantages of the present invention will become readily apparent from the following detailed description, the accompanying drawings, and the appended claims.

DETAILED DESCRIPTION

Figure 1:
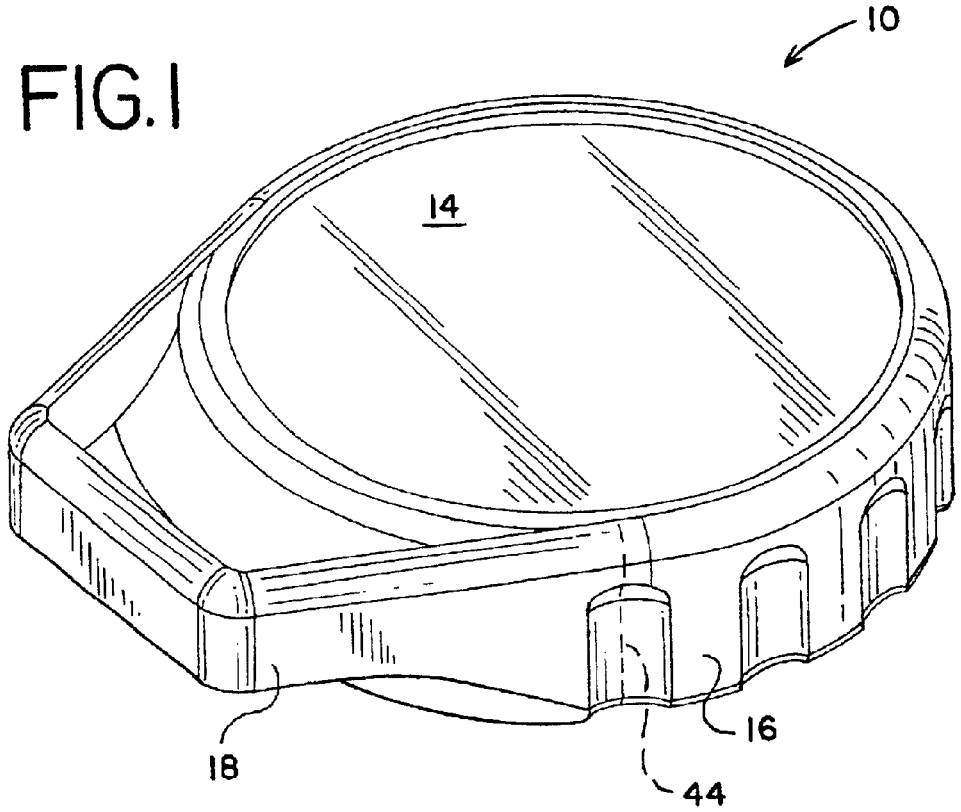
FIG. 1 is top perspective view of a snap-on closure embodying the principles of the present invention.
Figure 2:
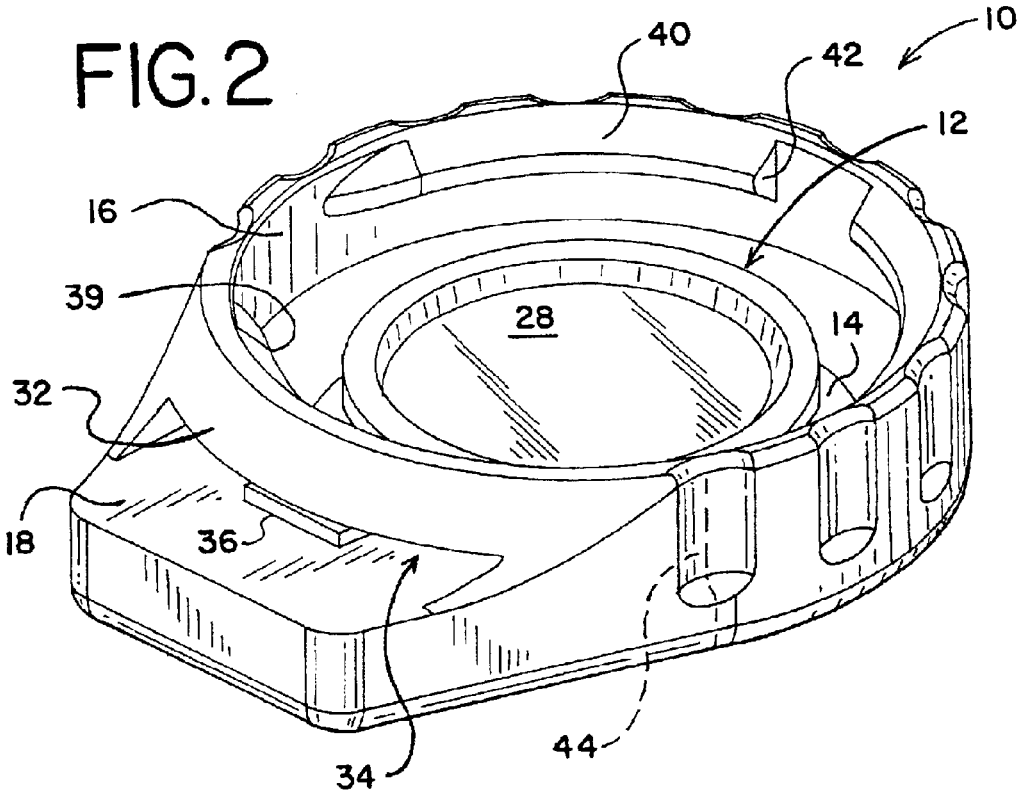
FIG. 2 is a perspective view of the inside of the present closure.
Figure 3:
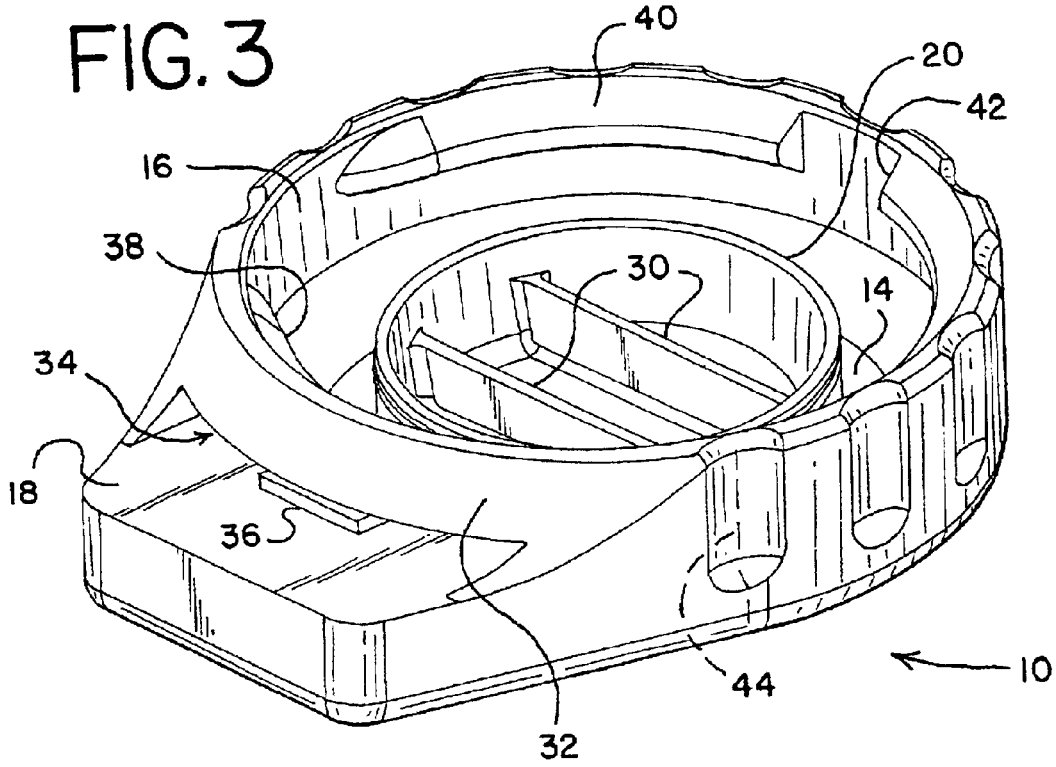
FIG. 3 is a perspective view similar to FIG. 2 showing the inside of the present closure without a sealing liner in place.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference to the drawings, therein is illustrated a snap-on closure 10 embodying the principles of the present invention. In the presently preferred form, the closure 10 includes a separately-formed sealing liner 12 for enhancing sealing cooperation with an associated container C. However, as will be evident from the present disclosure, a closure configured in accordance with the principles disclosed herein need not include the separate sealing liner 12. Closure 10 can be fabricated in accordance with conventional manufacturing techniques, including compression molding an injection molding.

The closure 10 includes a generally circular top wall portion 14, and an annular skirt portion 16 which depends from the top wall portion. In the preferred form, the closure 10 includes a lever-like removal tab 18 which projects forwardly from the skirt portion 16, and which facilitates manipulation and removal of the closure from the container C by consumers.

Figure 4:
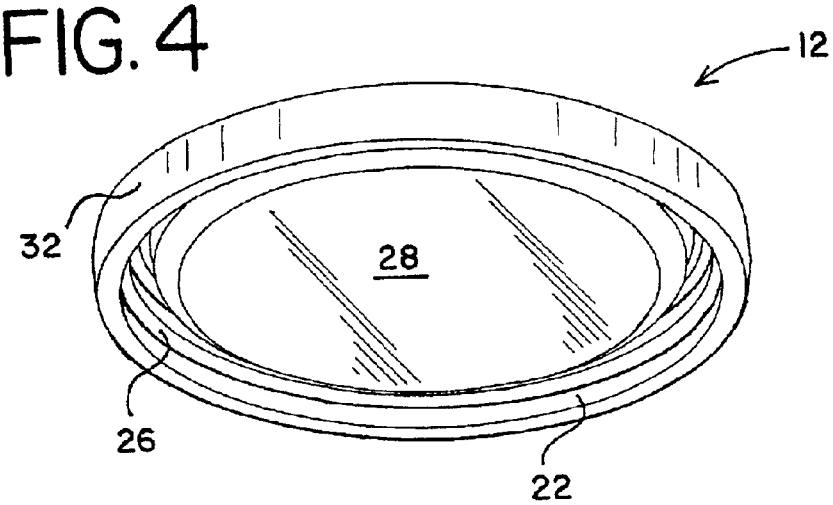
FIG. 4 is a perspective view of the sealing liner of the present closure.
Figure 5:
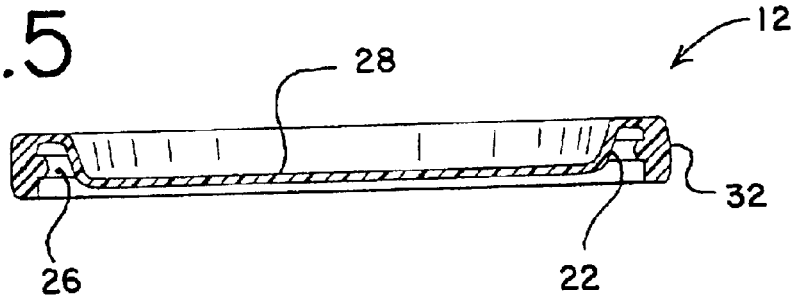
FIG. 5 is a cross-sectional view of the sealing liner shown in FIG. 4.
Figure 6:
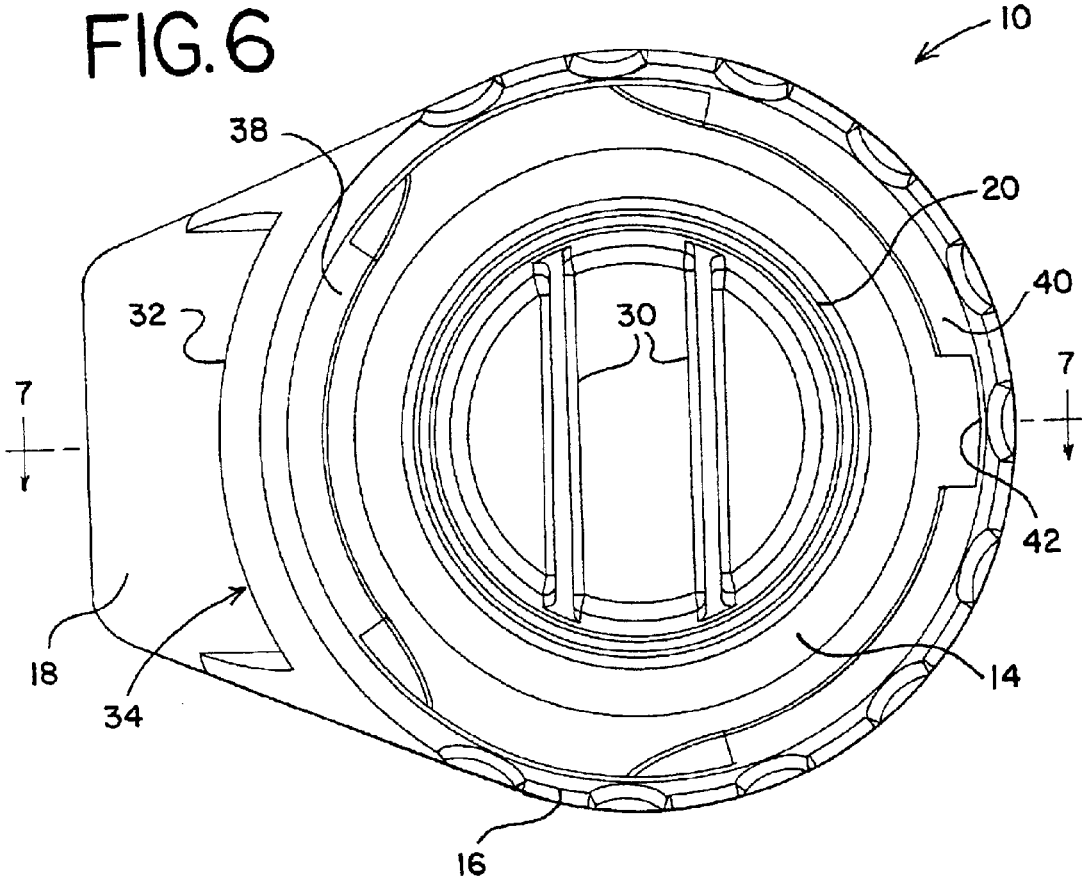
FIG. 6 is a bottom plan view of the inside of the present closure, without the sealing liner.
Figure 7:
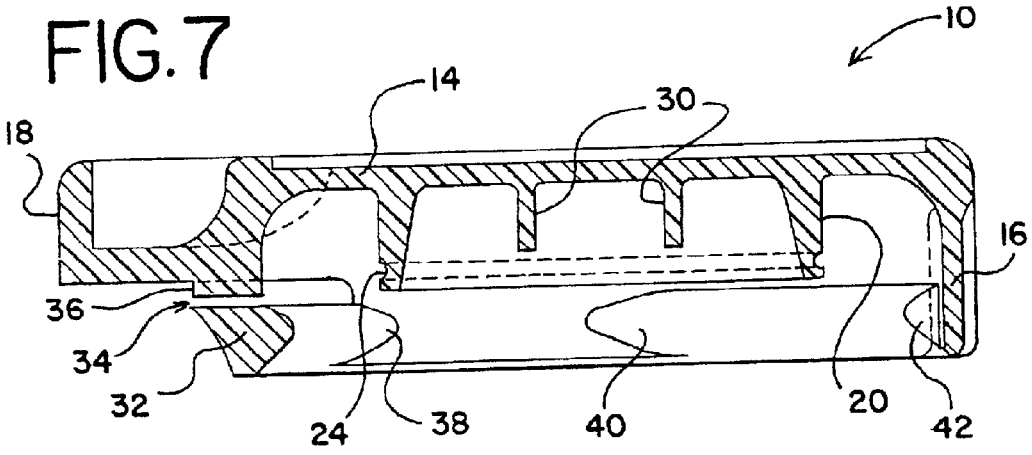
FIG. 7 is a cross-sectional view taken along lines 7—7 of FIG. 6.

In the illustrated embodiment, closure 10 is configured to effect a so-called plug seal with the associated container C, and to this end, the closure includes a sealing plug 20 depending from an inside surface of the top wall portion 14 for disposition generally within the mouth of the associated container. While the sealing plug 20 may be configured for sealing engagement with the interior of the container C, it is presently preferred that the closure 10 include the sealing liner 12 for disposition on the sealing plug, such that the sealing liner is positioned for sealing engagement with the container. To this end, the disc-shaped sealing liner 12 defines an annular channel 22 (FIGS. 4 and 5) within which is positioned the free edge of the sealing plug 20. Retention of the sealing liner 12 on the sealing plug 20 is facilitated by the provision of a retention lip on one of the outwardly facing surface of the sealing plug and the liner, with the other of the sealing plug and liner defining an annular retention groove for receiving the retention lip. In the illustrated embodiment, the outwardly facing surface of the sealing plug 20 defines an annular retention groove 24 which receives an annular retention lip 26 defined by the sealing liner 12 generally within annular groove 22.

It is presently contemplated that in one form, the sealing liner 12 be separately formed from the remainder of closure 10, and then assembled with the closure by disposition on sealing plug 20. Formation of the sealing liner 12 by compression molding is presently contemplated, with the liner formed from suitable material such as ethylene vinyl acetate (EVA), or like materials as are known in the art for such applications. As will be recognized by those familiar with the art, these types of liner materials are relatively expensive (as opposed to the polypropylene from which the remainder of the closure is typically formed), and as such, it is desirable to limit the amount of material employed for manufacture of the sealing liner 12. To this end, the sealing liner 12 is preferably configured to have an axial dimension less than the axial dimension of the sealing plug 20. In the preferred form, the sealing liner 12 includes a central portion 28 positioned generally within the sealing plug 20 in spaced relationship to the top wall portion 14. Support of the sealing liner 12 in association with the sealing plug 20 is facilitated by the provision of at least one support rib which depends from the top wall portion 14 generally within the sealing plug for supporting the central portion 28 of the sealing liner. In the illustrated embodiment, a pair of support ribs 30 are provided, with the support ribs 30 arranged in parallel relationship to each other. The one or more support ribs 30 are preferably arranged such that a removal tab 18 projects outwardly from the skirt portion 16 perpendicularly to the support ribs, with the closure thus configured so as to promote flexure during removal generally along a flexure region which extends across the top wall portion generally between the center of the top wall portion and the removal tab 18.

By the above-described configuration of the sealing plug 20 and sealing liner 12, sealing of the closure 10 with the associated container C is effected generally along the outside surface 32 of the sealing liner 12 where the sealing liner engages the inside surface of the mouth of container C.

Figure 8:
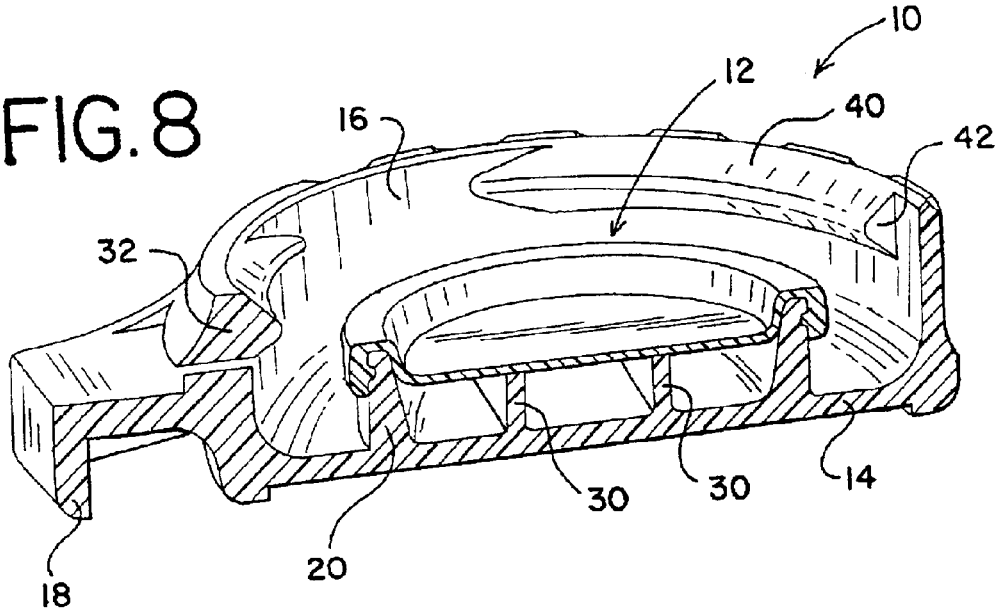
FIG. 8 is a cut-away, perspective view of the present closure.
Figure 8A:
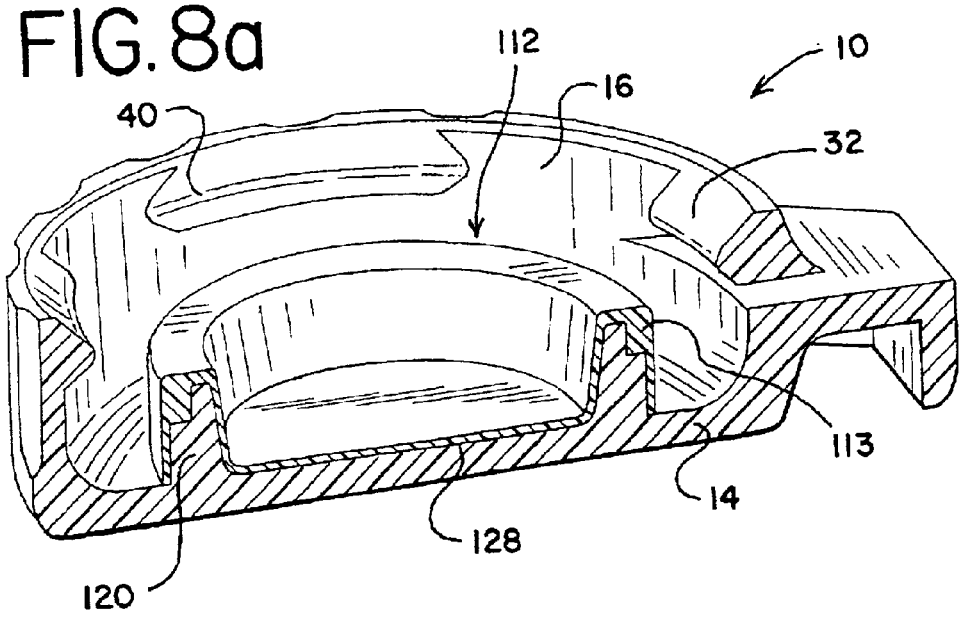
FIG. 8*a* is a view similar to FIG. 8 illustrating an alternate form of a sealing liner of the present closure.

FIG. 8*a* illustrates an alternate embodiment of the present closure, including a sealing liner 112 molded in situ on the associated modified sealing plug 20. The sealing liner can be formed by compression molding in position on the sealing plug. In this embodiment, the liner 112 is coextensive with the sealing plug 120, and includes a central portion 128 adjacent to wall portion 14. For this embodiment, the closure is formed without support ribs 30, with the liner preferably including an outwardly facing seal bead 113 generally adjacent a free edge of the sealing plug 120.

As noted, the present closure is preferably configured for snap-on application to the associated container C, and is configured for retention on the container without resort to thread formations or the like. In order to retain the closure 10 on the circumferential bead of the container C, the closure includes at least one, and preferably a plurality of retention beads which project inwardly from the skirt portion 16 of the closure. Notably, the retention beads of the present closure not only effect retention of the closure on the container prior to removal, but further are configured to cooperate with the container for providing tamper-evidence. To this end, the skirt portion 16 of the closure 10 includes a deformable portion 32 positioned generally beneath the removal tab 18. The deformable region 32 is separated and distinguished from the skirt portion thereabove by a gap 34 which extends above the deformable region 32. The deformabic region 32 is thus configured for permanent stretching and deformation attendant to closure removal from container C for tamper-evidence, as will be described. In the preferred form, proper seating and application of the closure, including deformable region 32, on the container C is facilitated by the provision of bridge element 36 positioned at the gap 34 for bearing axial loads during application of the closure to the container. As shown, bridge element 36 is positioned on the skirt portion 16 just above the deformable region 32, generally at the underside of removal tab 18.

As noted, retention of closure 10 on the associated container is preferably provided by the provision of a plurality of retention beads which are circumferentially spaced. In the preferred form, a retention bead 38 is provided on deformable region 32 of the skirt portion 16, with an elongated retention bead 40 provided on the skirt portion opposite the removal tab 18. In the illustrated embodiment, retention bead 40 extends circumferentially of the skirt portion 16 about 180°, and cooperates with retention bead 38 to retain the closure on the container prior to removal. As illustrated, the elongated retention bead preferably defines an opening 42 positioned diametrically opposite the removal tab, with the opening 42 facilitating removal of mold tooling employed for manufacture of the present closure.

Figure 9:
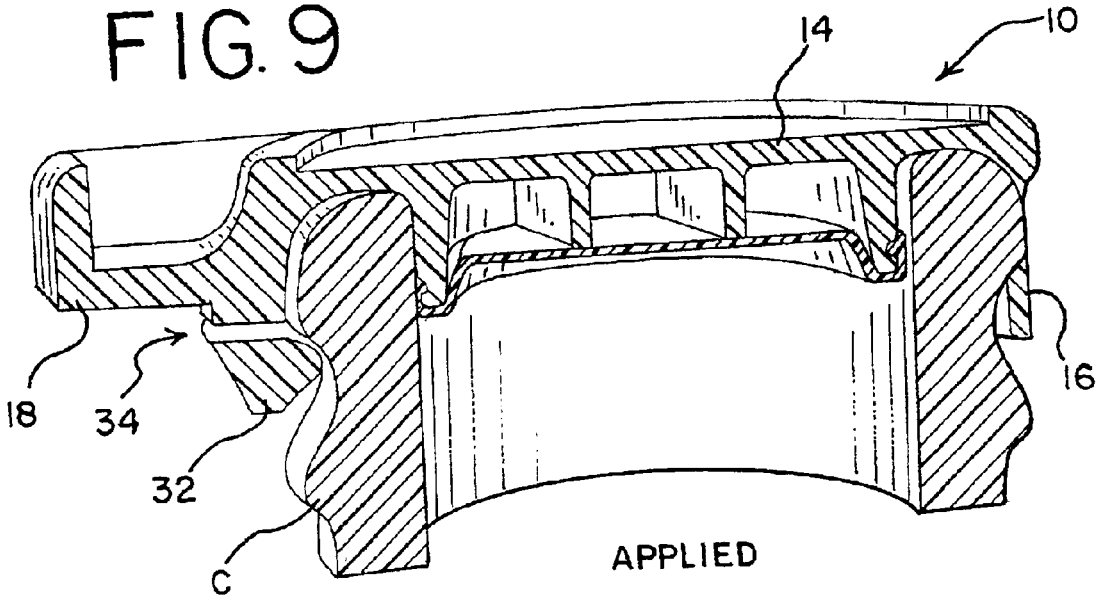
FIG. 9 is a finite element analysis illustration of the present closure when applied to an associated container.

From the foregoing description, application and removal of the present closure 10 will be readily appreciated. With particular reference to FIG. 9, a finite element analysis is illustrated therein, wherein the closure 10 is shown applied to the associated container C. In this position, the sealing liner 12 disposed on sealing plug 20 sealingly engages the inside surface of the mouth of the container C, with the present closure preferably configured to substantially separate and isolate the loads which are created for effecting sealing engagement from those loads which act, via the retention beads of the closure, for retaining the closure in position on the container. The loads exerted upon the plug seal are generally oriented in a radial direction, with the sealing plug and its liner generally tending to slide upwardly during closure removal.

Figure 10:
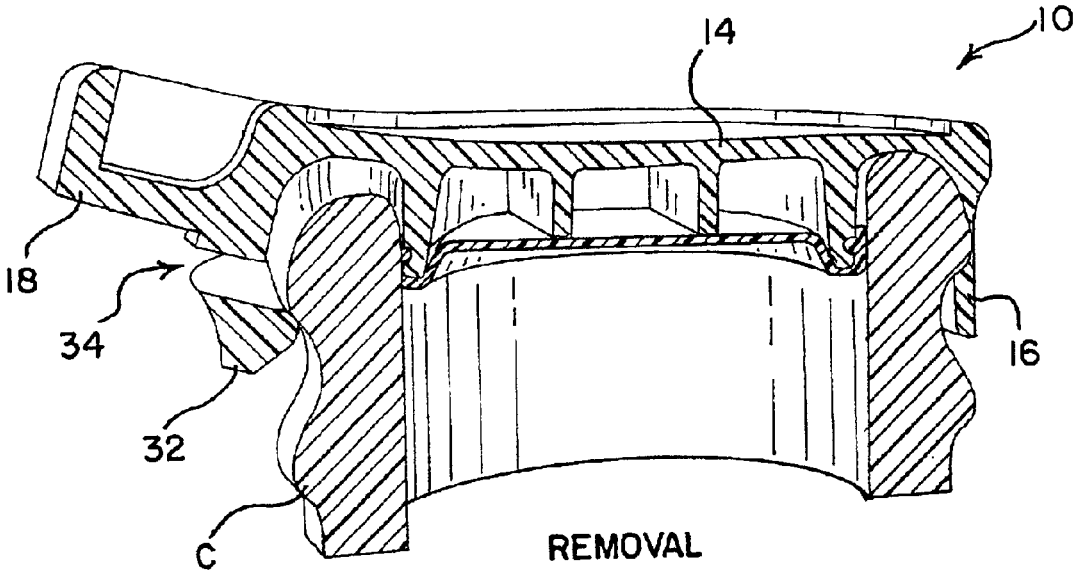
FIG. 10 is a finite element analysis illustration of the present closure during removal from an associated container.

FIG. 10 is a finite element analysis illustration of the present closure during removal from the associated container. As will be observed, the closure generally flexes along a flexure region which extends across the top wall portion 14 generally between the center of the closure and the removal tab 18. During closure removal, the retention bead 38 on deformable region 32 of the skirt portion acts to retain the deformable region on the container, resulting in permanent stretching and deformation of the deformable region as the closure is removed from the container. As the closure is moved upwardly by manipulation of removal tab 18, the deformable region 32 eventually stretches and deforms sufficiently as to slip off of the container, thus permitting disengagement of the elongated retention bead 40 from the container, and removal of the closure.

If desired, the skirt portion 16 of the closure can be configured to define a pair of weakened regions, such as shown in phantom line at 44, positioned on respective opposite sides of the removal tab 18 to facilitate flexure and removal of the closure. The weakened regions 44 can be suitably molded into the closure 10, or formed by cutting or scoring after molding, and are positioned generally at respective opposite sides of the flexure region which extends across top wall portion 14. As noted, support ribs 30 preferably extend in a direction perpendicular to removal tab 18 to facilitate flexing of the closure during removal.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A snap-on closure for a container comprising:

a top wall portion;

an annular skirt portion depending from said top wall portion;

a removal tab projecting forwardly from said-skirt portion, said skirt portion including a deformable portion positioned adjacent to said removal tab, and comprising a pair of weakened regions on respective opposite sides of said removal tab;

a sealing plug depending from an inside surface of said top wall portion for disposition generally within a mouth of an associated container; and a sealing liner disposed on said sealing plug for sealing engagement with said container;

wherein said sealing liner is molded in situ and is coextensive with and conforms to inwardly and outwardly facing surfaces of said sealing plug, and includes a central portion positioned generally within said sealing plug adjacent said top wall portion.

2. A snap-on closure in accordance with claim 1, wherein:

one of said sealing plug and said sealing liner defines an annular retention lip, and the other of said sealing plug and said sealing liner defines an annular retention groove for receiving said retention lip.

3. A snap-on closure in accordance with claim 1, wherein:

said annular skirt portion includes said deformable region positioned generally beneath said removal tab.

4. A snap-on closure in accordance with claim 3, wherein:

said annular skirt portion defines a gap extending above said deformable region.

5. A snap-on closure in accordance with claim 4, wherein:

said annular skirt portion includes a bridge element positioned at said gap for bearing axial loads during application of said closure to said associated container.

6. A snap-on closure in accordance with claim 5, wherein:

said bridge element is positioned on said annular skirt portion above said deformable region.

7. A snap-on closure in accordance with claim 3, wherein:

said annular skirt portion includes a plurality of inwardly projecting, circumferentially spaced retention beads, said deformable region of said skirt portion including one of said retention beads.

8. A snap-on closure in accordance with claim 7, including:

an elongated one of said retention beads on said annular skirt portion opposite said removal tab, said elongated retention bead comprising an opening positioned diametrically opposite said removal tab.

9. A snap-on closure in accordance with claim 1, wherein:

said annular skirt portion includes at least one inwardly projecting retention bead for retaining said closure on said container.

10. A snap-on closure for a container, comprising:

a top wall portion;

an annular skirt portion depending from said top wall portion; said skirt portion including at least one inwardly projecting retention bead;

a removal tab projecting from said skirt portion, said annular skirt portion comprising a pair of weakened regions positioned on respective opposite sides of said removal tab;

a sealing plug depending from an inside surface of said top wall portion for disposition generally within a mouth of an associated container; and a sealing liner disposed on said sealing plug, said sealing liner being coextensive with and conforming to inwardly and outwardly facing surfaces of said sealing plug.

11. A snap-on closure in accordance with claim 10, wherein:

one of said outwardly facing surface of said sealing plug and said inwardly facing surface of said sealing liner includes an annular retention lip, and the other of said outwardly facing surface of said sealing plug and said inwardly facing surface of said sealing liner comprises an annular retention groove for receiving said retention lip.

12. A snap-on closure in accordance with claim 11, wherein:

said outwardly facing surface of said sealing plug defines said retention groove, said inwardly facing surface of said sealing liner including said retention lip.

13. A snap-on closure in accordance with claim 11, wherein:

said skirt portion includes a deformable region positioned generally beneath said removal tab, said skirt portion including a plurality of said retention beads arranged in circumferentially spaced relationship, one of said retention beads being positioned on said deformable region.

14. A snap-on closure in accordance with claim 10, wherein:

said inwardly facing surface of said sealing liner defines an annular channel within which is positioned a free edge of said sealing plug.

15. A snap-on closure in accordance with claim 10, wherein:

said sealing liner includes an outwardly facing annular seal bead generally adjacent a free edge of said sealing plug.

16. A snap-on closure for a container, comprising:

a top wall portion;

an annular skirt portion depending from said top wall portion, said skirt portion including a plurality of inwardly projecting; circumferentially spaced retention beads;

a removal tab projecting forwardly from said skirt portion, said annular skirt portion including a deformable region positioned adjacent to said removal tab, with one of said retention beads being positioned on said deformable region, said skirt portion comprising a pair of weakened regions positioned on respective opposite sides of said removal tab and said deformable region;

an annular sealing plug depending from an inside surface of said top wall portion; and a sealing liner disposed on an outwardly facing surface of said sealing plug for sealing engagement with an inwardly facing surface of said container, whereby during closure removal, upward manipulation of said removal tab deforms said deformable region of said annular skirt portion for disengagement of said one of said retention beads positioned thereon, said weakened regions facilitating flexure of said closure, said sealing plug and said sealing liner sliding upwardly during closure removal.

17. A snap-on closure in accordance with claim 16, wherein:

said closure defines a flexure region extending across said top wall portion.

18. A snap-on closure in accordance with claim 17, wherein:

said flexure region is positioned generally between the center of said top wall portion and said removal tab.

19. A snap-on closure in accordance with claim 16, said sealing liner defining an annular channel for receiving a free edge of said sealing plug, and including a central portion positioned generally within said sealing plug.

20. A snap-on closure in accordance with claim 16, wherein:

said sealing liner is coextensive with said sealing plug.

21. A snap-on closure for a container, comprising:

a top wall portion;

an annular skirt portion depending from said top wall portion, said skirt portion including a plurality or inwardly projecting, circumferentially spaced retention beads;

a removal tab projecting forward from said skirt portion;

said skirt portion including a deformable region positioned adjacent to said removal tab, with one of said retention beads being positioned on said deformable region, said skirt portion comprising a pair of weakened regions positioned on respective opposite sides of said removal tab and said deformable region;

an annular sealing plug depending from an inside surface of said top wall portion; and a sealing liner disposed on said sealing plug, whereby during closure removal, manipulation of said removal tab deforms said deformable region for disengagement of said one of said retention beads positioned thereon, said weakened regions facilitating flexure of said closure, said sealing plug and said sealing liner sliding upwardly during closure removal, wherein said skirt portion includes an elongated one of said retention beads positioned opposite said removal tab, said elongated retention bead circumferentially extending about 180° of said skirt portion.

22. A snap-on closure in accordance with claim 21, wherein:

said elongated retention bead comprises an opening positioned diametrically opposite said removal tab.

* * * * *